United States Patent [19]

Hale

[11] Patent Number: 5,018,739

[45] Date of Patent: May 28, 1991

[54] GOLF PUTTING PRACTICE DEVICE

[76] Inventor: Robert B. Hale, 6302 W. Loretta Dr., Indianapolis, Ind. 46241

[21] Appl. No.: 507,024

[22] Filed: Apr. 10, 1990

[51] Int. Cl.[5] ..... A63B 57/00

[52] U.S. Cl. ..... 273/201

[58] Field of Search ..... 273/33, 32.5, 201, 202, 273/203, 32 R, 32 B, 183 E, 187 R, 191 R, 192, 193 R, 193 A

[56] References Cited

U.S. PATENT DOCUMENTS

| | | | |
|---|---|---|---|
| 3,510,136 | 5/1970 | Ruspoli | 273/192 |
| 3,599,987 | 8/1971 | Melton | 273/201 |
| 4,511,141 | 4/1985 | Dumas | 273/55 B |

FOREIGN PATENT DOCUMENTS

| | | | |
|---|---|---|---|
| 583120 | 9/1959 | Canada | 273/192 |

OTHER PUBLICATIONS

*Blade Gauge,* author unknown, publication unknown.

"Putting: Contact the ball's performance point with the putter's", by Davis Love, Jr., p. 63, Dec., 1988, issue Golf Digest.

Article by Chuck Cook, and illustrations with reference to "Use a Plane Board to Check Your Path", pp. 52–53, Sep. 1989, Golf Digest.

*Primary Examiner*—Theatrice Brown

*Attorney, Agent, or Firm*—Woodard, Emhardt, Naughton, Moriarty & McNett

[57] ABSTRACT

A base is provided with a vertical guide wall to establish a line of direction for a putter head. There is a ball storage platform supported above the base and which has a trough generally directed toward the plane of the guide wall but from the back side of it. A ball receiving and placing member is pivotally mounted to the base for movement from a rest position to a position at the front of the wall to receive a ball from the storage platform and place it in front of the wall in position to be putted.

5 Claims, 5 Drawing Sheets

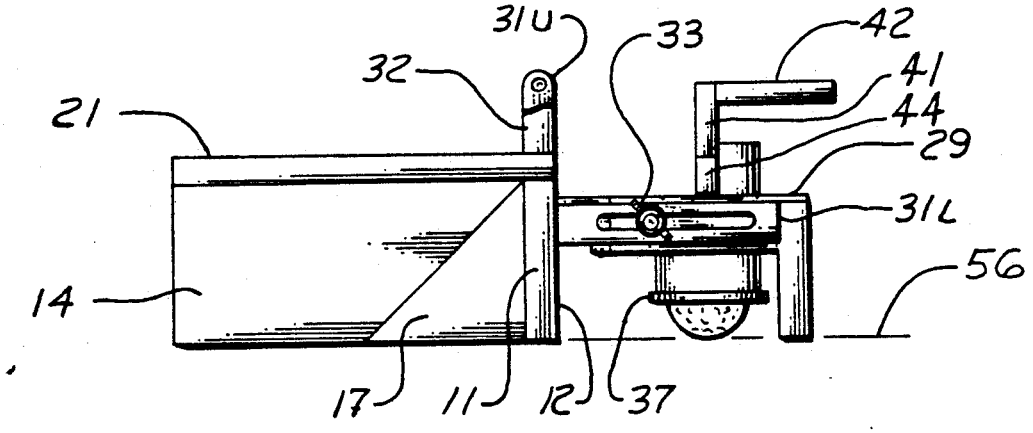
FIG. 2
FIG. 3
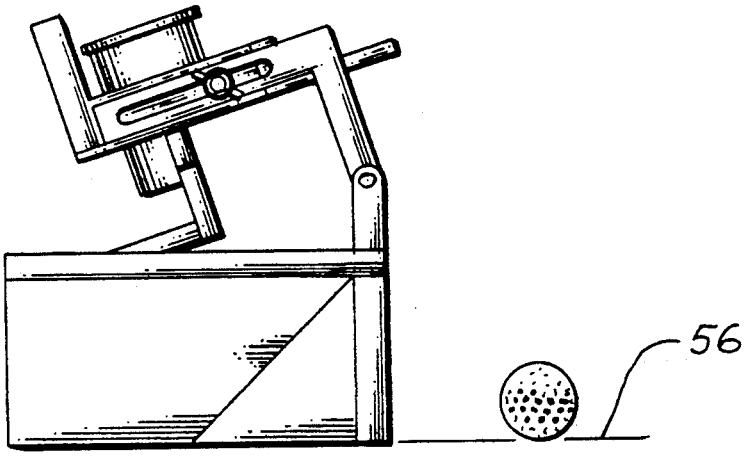

GOLF PUTTING PRACTICE DEVICE'

BACKGROUND OF THE INVENTION

1. Field of the Invention

This invention relates to golf practice devices and more particularly to a device which can be placed on a floor or the ground during practice sessions to assist the golfer in perfecting a putting stroke.

2. Description of the Prior Art

Many devices have been offered to help improve putting. They vary from putting practice greens to indoor practice mats to putter designs to alignment devices, for example. They have met varying degrees of success. There has remained a need for a device which enables convenient placement of a ball on the putting surface for putting, without the necessity for frequent retrieving, stooping, picking up, and repositioning the ball during putting practice.

SUMMARY OF THE INVENTION

Described briefly, according to a typical embodiment of the present invention, a base is provided with a vertical guide wall to establish a line of direction for the putter head. There is a ball storage platform supported above the base and which has a trough generally directed toward the plane of the guide wall but from the back side of it. A ball receiving and placing member is pivotally mounted to the base for movement from a rest position to a position at the front of the wall to receive a ball from the storage platform and place it in front of the wall in position to be putted.

BRIEF DESCRIPTION OF THE DRAWINGS

FIG. 2 is an end view thereof as viewed in the direction of the arrows 2—2 in FIG. 1.

FIG. 3 is an end view thereof like FIG. 2 but with the ball placer in the stored position.

DESCRIPTION OF THE PREFERRED EMBODIMENT

Figure 1:
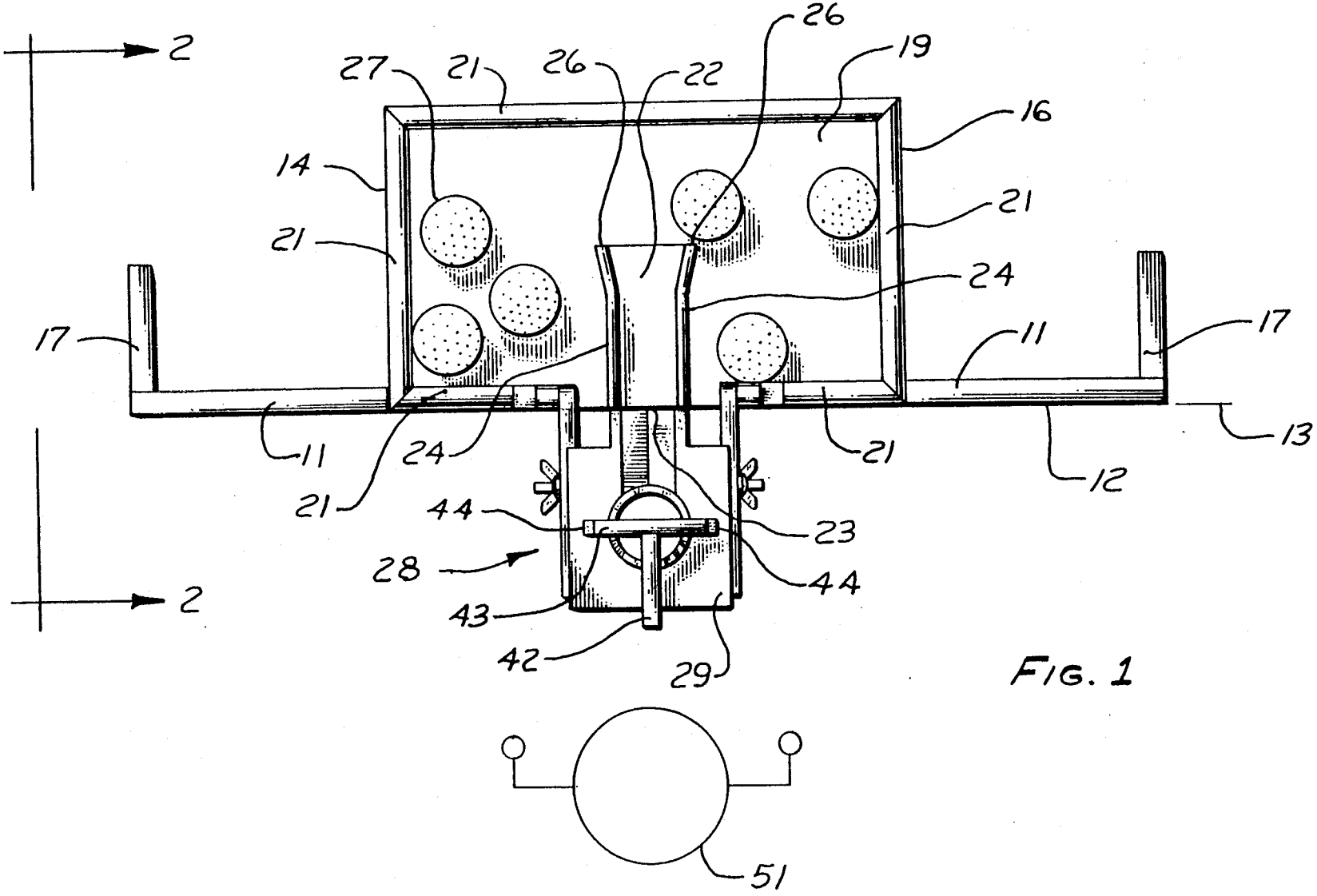
FIG. 1 is a top plan view of the practice device according to a typical embodiment of the present invention, with the ball placer in the active position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawings in detail, FIG. 1 shows the main guide wall member 11 which has a flat front face 12 disposed in a vertical plane 13. The rear support members 14 and 16 are fastened to the back side of member 11 and extend rearwardly therefrom, and provide balance and support for the member 11 so that it can be placed on a supporting surface such as the ground or grass or a floor to hold wall 12 in the vertical plane 13. Back braces 17 may be provided at opposite ends of the member 11 and fastened to the back face thereof. All of these members 11, 14, 16 and 17 may have a flat bottom such as the lower edge 18 of member 11, if desired. However, if there is a likelihood that the apparatus would be placed on an uneven surface, appropriate recesses or hollows could be employed so as to enable maintenance of the vertical attitude of the planar wall front face 12 in plane 13.

Figure 6:
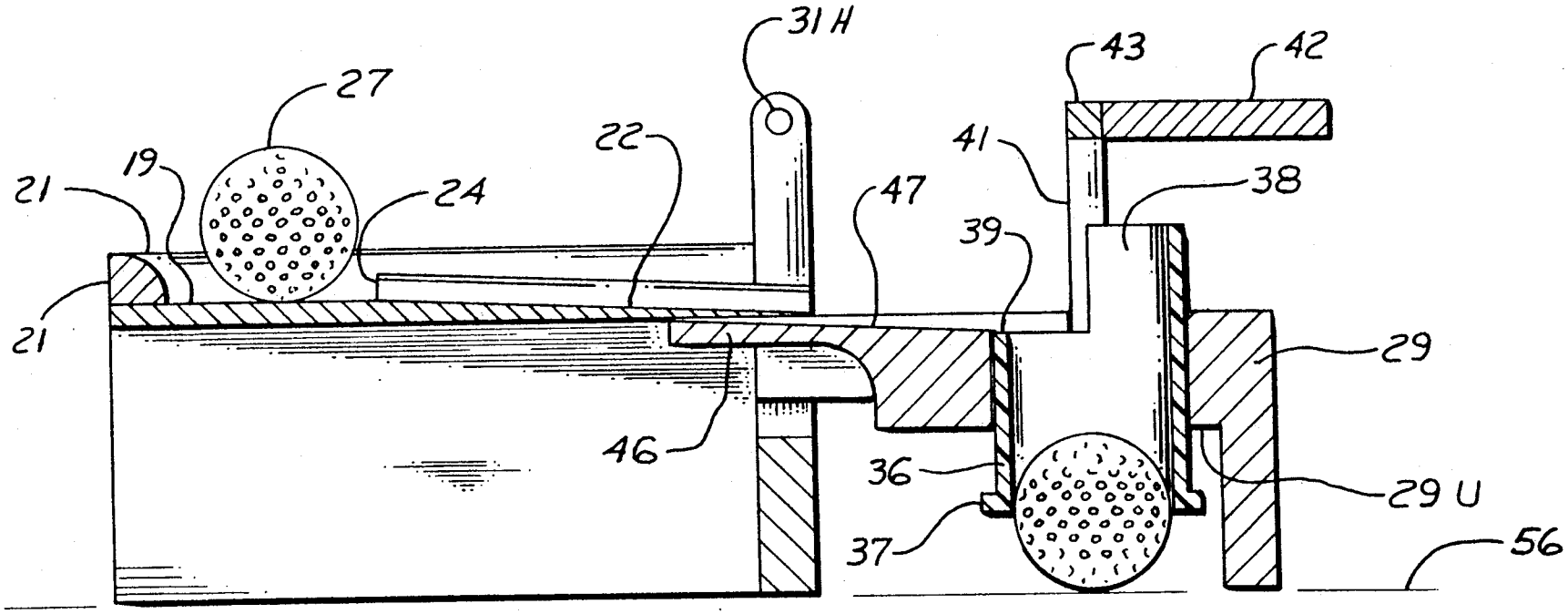
FIG. 6 is a section taken at line 6—6 in FIG. 5 and viewed in the direction of the arrows.

The members 11, 14 and 16 provide a base for a ball storage area which includes a platform 19 mounted on the walls 11, 14 and 16 and having a rail 21 around the two sides rear and part way across the front of the platform 19. There is a gap between the ends of this rail at the center front of the platform where a shallow trough 22 is provided in the platform and extends rearwardly from the front edge 23 and upwardly to the top of the platform. Side rails 24 are provided at each side of this trough from the front rails 21 to the rear ends 26 which are flared slightly outwardly to admit a golf ball such as 27 from the storage area around the rear edge 26 and into the trough 22. The trough 22 slopes downwardly from the top of the platform 19 at the rear ends of the side rails 24 to the front edge of the platform as shown in FIG. 6.

Figure 4:
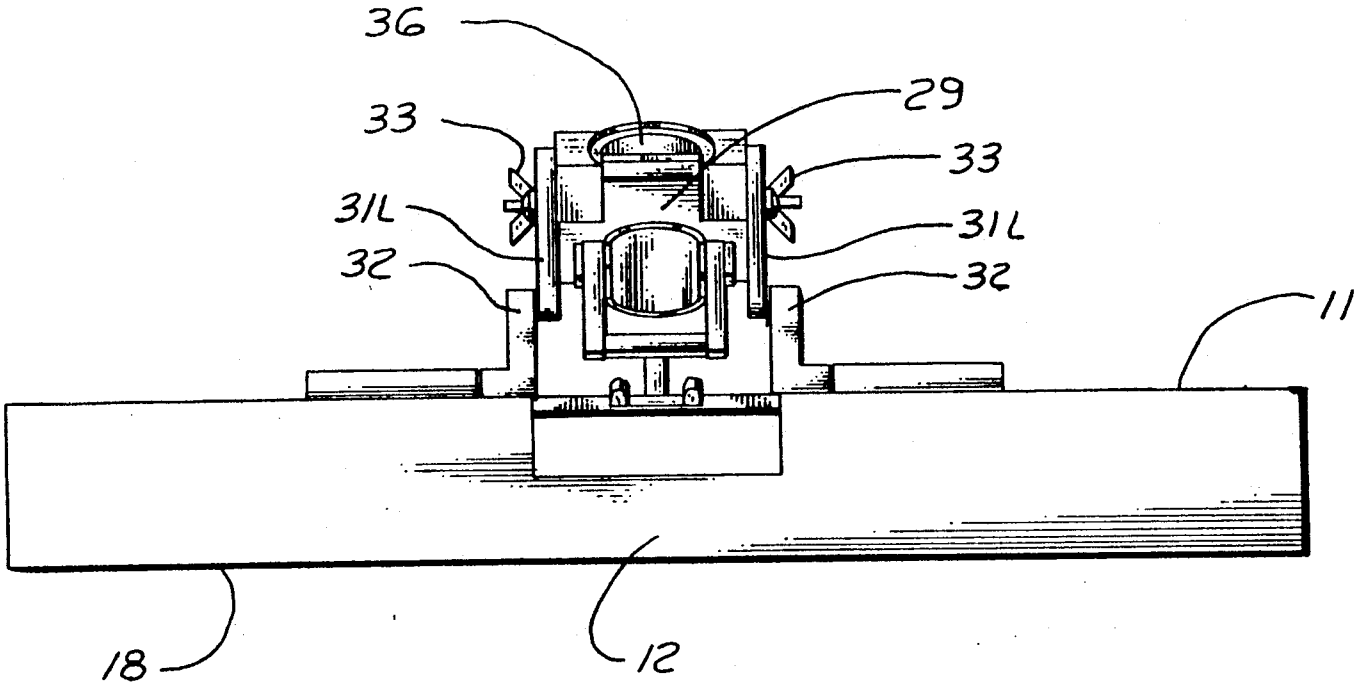
FIG. 4 is a front elevational view thereof with the ball placer in stored position.
Figure 5:
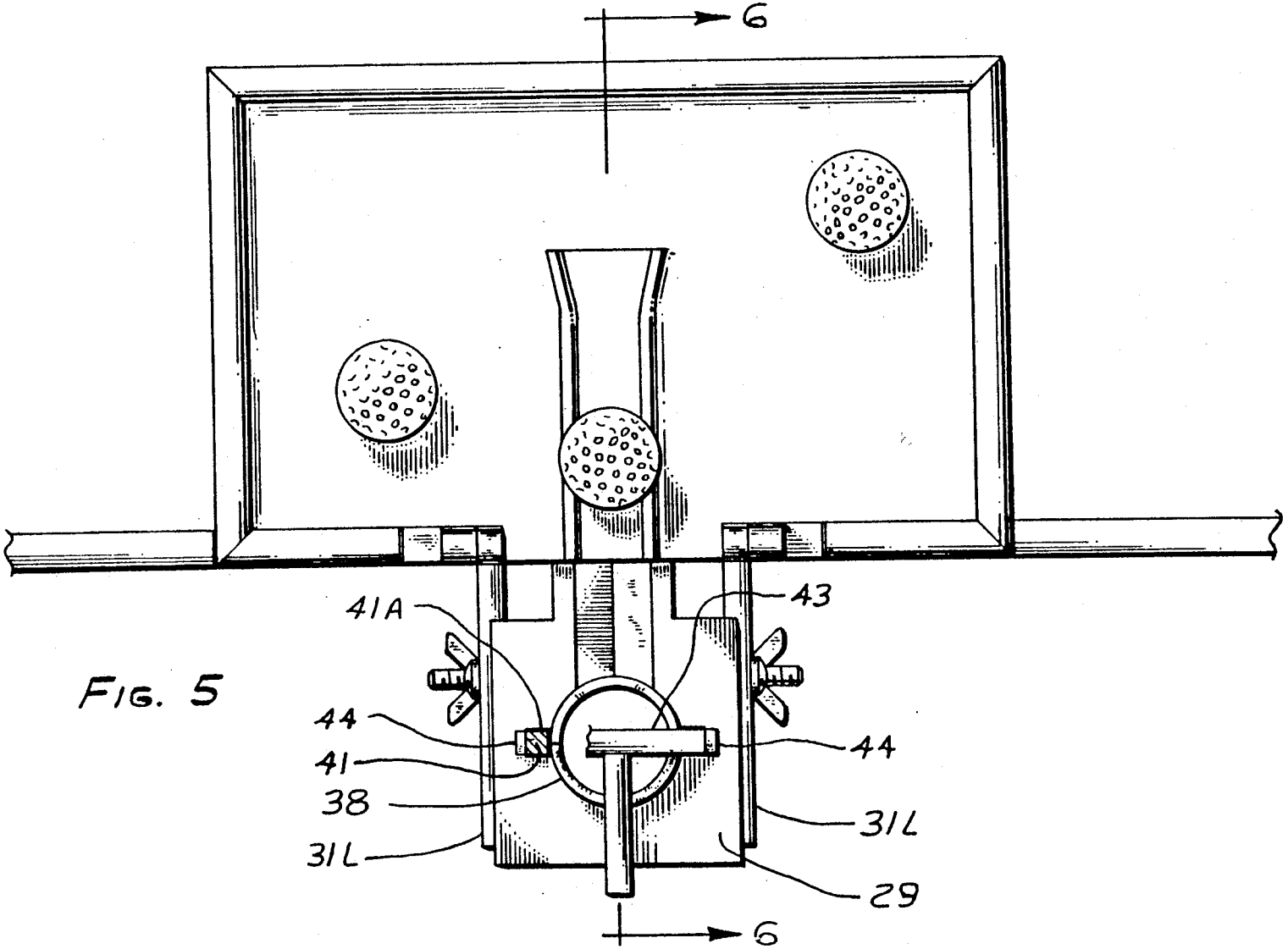
FIG. 5 is an enlarged top plan view of the ball placer in the active position.

A ball placing assembly 28 is pivotally mounted to the member 11 and moveable from a rest position behind plane 13 as shown in FIGS. 3 and 4, to an active position in front of plane 13 as shown in FIGS. 1, 2, 5 and 6. The placing device includes a body 29 slidably mounted in two L-shaped arms 31 hinged to support posts 32 mounted on the member 11. The body 29 has grooves on opposite sides and which receive the portions of arms 31 which are slotted to receive wing bolts 33. In this way, upon loosening the wing bolts, the body 29 can be moved toward and away from the guide surface 12 of member 11, when desired (FIG. 2).

The placing device also includes a ball guide drop tube 36 which is slidably receivable in the body 29. It has a flange 37 at its lower end to limit its upper travel in the body 29. It has a front ball-stop wall 38 extending 180° around the front of the tube above the rear wall 39 (FIG. 6) at the top of the tube. The tube has vertically extending keys 41 on each side which are slidably received in matching keyways 41A in the body 29. A lift arm 42 is mounted on a crossmember 43 fastened to the upper ends of the keys 41 where the keys serve as support posts for the crossmember. Whereas the body 29 is secured in the arms 31L at the desired position, the drop tube 36 is freely slidable vertically in the body 29 except as limited by the flange 37 at the bottom of tube 36 and by the stops 44 fixed to the outer surface of the posts 41.

It was mentioned above that there is a sloping trough 22 from the platform to the front edge of the platform. The body 29 has a bridge 46 cantilevered from the rear end of it and which is disposed under the platform 19 when the placer device is in the active position shown in FIGS. 1, 2, 5 and 6. This bridge also has a sloping trough 47 in it to guide a ball which moves down trough 22 and down trough 47 into the top of the drop tube 36. The travel of the ball is stopped by the stop wall 38, in this process.

In the use of the apparatus, the golfer, shown schematically at 51 in FIG. 1, stands at that location which is the distance that he or she designates as appropriate with respect to the plane 13 so that putting practice can be commenced with a ball below the location of the drop tube 36. That tube location is adjustable, as indicated above, to accommodate the length of the putter face. In other words, with the putter positioned so that the toe end of the blade is immediately adjacent wall 12, the wing bolts and associated body 29 are adjusted and moved in or out with respect to wall 12 so that the sweet spot of the putter is in the same vertical plane as the center line of the drop tube 36. Then the wing bolts are secured. The golfer can then move a ball from the storage platform area to the entrance ends 26 of wall 24 whereupon, with a little nudge, the ball will travel down the inclined trough 22 and trough 47 and into the top open end of drop tube 36. When the ball has dropped onto the putting surface 56, the golfer can then place the putter head under the arm 42 and lift the drop tube 36 from around the ball and, when the flange 37 strikes the lower face 29U of the body 29, the hole placing assembly will begin to be pivoted up around the hinge pins 31H (FIG. 6) and can be tilted to the rest position shown in FIGS. 3 and 4. Then the golfer can proceed to Putt the ball, using the wall 12 as a guide for the putter head. After that ball has been struck, and comes to rest, the golfer can then pivot the placer device from the rest position back to the active position. The drop tube 36 will then automatically slip down to the position where the stops 44 on posts 41 will strike the upper face of body 29 and it will remain at rest at that height. Then the golfer can move another ball onto the entrance trough 22 whereupon it will move into position over the drop tube 36 and drop through it onto the surface 56. Then the procedure can be repeated.

This apparatus makes it convenient for a golfer to practice putting without continuous stooping to place balls in position to strike them, and without repeatedly moving out of position to retrieve balls. Because the drop tube so freely slides in the body 29, it can be lifted straight up from the ball before the body 29 begins to pivot around the hinge pins. In this way there is no disturbance of the ball when lifting the drop tube away from it, so there is no need to reposition the ball with the putter head before taking the putter stroke.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A putting practice apparatus comprising:

a putter guide member having a planar wall and having base means for resting on a supporting surface so as to position the wall in a vertical plane; and a ball placing device associated with the wall and movable from a rest position behind the plane containing the wall surface to an active position in front of the wall surface, the placing device including a ball guide to receive a golf ball from storage and guide the ball into position on a supporting surface in front of the wall surface;

the placing device further including a bracket slidably receiving the ball guide therein and pivotally mounted on the guide member whereby the ball guide is vertically slidable when the placing device is in active position for raising the ball guide vertically from a ball placed on the supporting surface.

2. The apparatus of claim 1 and wherein:

the ball guide has at least two generally parallel wall areas;

the ball guide wall areas being disposed vertically when the Placing device is in the active position and the wall areas having an opening therein at one end of the wall areas and which is a side opening at the top of the wall areas and faces the plane when the ball placing device is in the active position, to admit a ball into the ball guide from the top to be dropped through the guide onto the supporting surface;

the bracket and ball guide having interfitting key and groove means to maintain the plane-facing orientation of the opening.

3. The apparatus of claim 2 and wherein:

the ball guide is a tube.

4. The apparatus of claim 1 and wherein:

the bracket includes a slide operable in a direction perpendicular to the pivot axis whereby the distance of the ball guide from the pivot axis can be changed and fixed at different distances to enable placement of a ball at a desired distance in front of the vertical plane.

5. A putting practice apparatus comprising:

a putter guide member having a planar wall and having base means for resting on a supporting surface so as to position the wall in a vertical plane; and a ball placing device associated with the wall and movable from a rest position behind the plane containing the wall surface to an active position in front of the wall surface, the placing device including a ball guide to receive a golf ball from storage and guide the ball into position on a supporting surface in front of the wall surface;

a bracket pivotally mounted to the guide member to swing said placing device about a pivot axis;

the ball guide being mounted on the bracket and swingable forward and downward about the axis to a position in front of the plane when the placing device is in the active position;

the apparatus further comprising:

a ball storage area associated with the guide member and behind the plane; and means for delivering a ball from the storage areas to the ball guide when the placing device is in the active position;

the means for delivering including a trough from the storage area to the plane; and the bracket including a second trough associated with the ball guide and operable with the bracket when pivoted to put the placing device in the active position for registering the second trough with the first-mentioned trough to guide a ball from the storage area to the ball guide the bracket further including a slide operable in a direction perpendicular to the vertical plane whereby the distance of the ball guide in front of the plane can be changed and fixed at different distances to enable placement of a ball at a desired distance in front of the vertical plane.

* * * * *